United States Patent [19]

Burkhardt

[11] 4,265,555

[45] May 5, 1981

[54] DUAL PITCH CARRIAGE DRIVE MECHANISM

[76] Inventor: Gottfried Burkhardt, Am Bahndamm 29, 8500 Nuremberg 1, Fed. Rep. of Germany

[21] Appl. No.: 70,148

[22] Filed: Aug. 27, 1979

[30] Foreign Application Priority Data

Sep. 14, 1978 [DE] Fed. Rep. of Germany ..... 2839944

[51] Int. Cl.[3] ..... B41J 19/00

[52] U.S. Cl. ..... 400/320; 400/307.2; 400/305; 400/328; 400/335; 74/436

[58] Field of Search ..... 400/293, 303, 305, 309, 400/310, 307.2, 320, 319, 328, 335, 903; 74/22 R, 22 A, 84, 216.5, 217 R, 225, 415, 436, 665 GE

[56] References Cited

U.S. PATENT DOCUMENTS

| | | | |
|---|---|---|---|
| 442,404 | 12/1890 | Steiger | 400/335 X |
| 2,307,886 | 1/1943 | Hansson | 74/436 X |
| 2,465,657 | 3/1949 | Norton | 400/309 X |
| 3,260,343 | 7/1966 | McCormick | 400/328 X |
| 3,540,565 | 11/1970 | Hanft et al. | 400/298 X |
| 3,926,061 | 12/1975 | Paulson | 400/303 X |
| 3,985,220 | 10/1976 | Rix et al. | 400/293 |
| 4,005,772 | 2/1977 | Kieffer et al. | 400/903 X |
| 4,067,430 | 1/1978 | Wienhold | 400/310 X |

FOREIGN PATENT DOCUMENTS

| | | | |
|---|---|---|---|
| 2039199 | 2/1972 | Fed. Rep. of Germany | 400/320 |
| 1315800 | 5/1973 | United Kingdom | 400/328 |

OTHER PUBLICATIONS

DE-GM (West German Utility Model) 77 00 648, Burkhardt, May 26, 1977, 5 pages.

IBM Technical Disclosure Bulletin, "Noise Reduction of Leadscrew Drive", Brown, vol. 21 No. 4, Sep. 1979, p. 1539.

*Primary Examiner*—Ernest T. Wright, Jr.

[57] ABSTRACT

Two carriage drive systems are arranged to be selectively coupled to a uniform stepping mechanism responsive to spacing signals whereby a carriage can be indexed across a writing line at 10 or 12 pitch increments.

6 Claims, 2 Drawing Figures

Fig_1
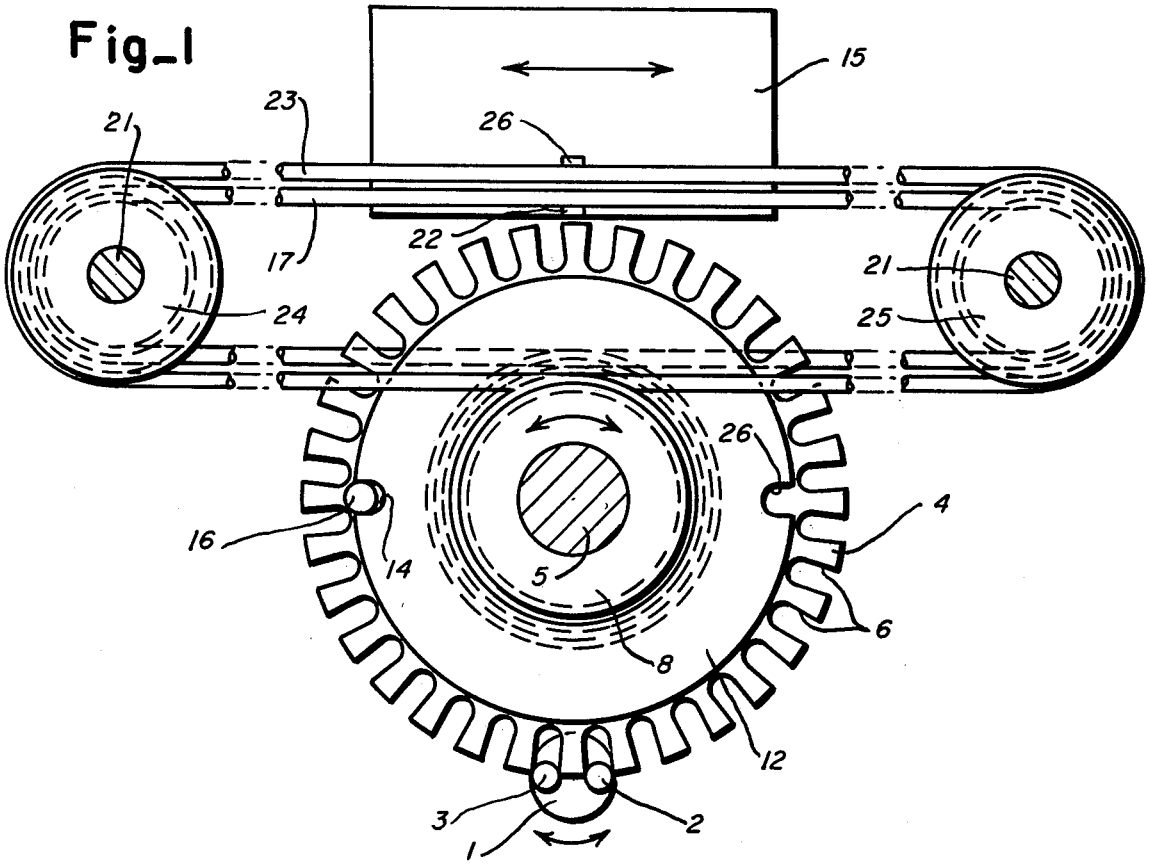
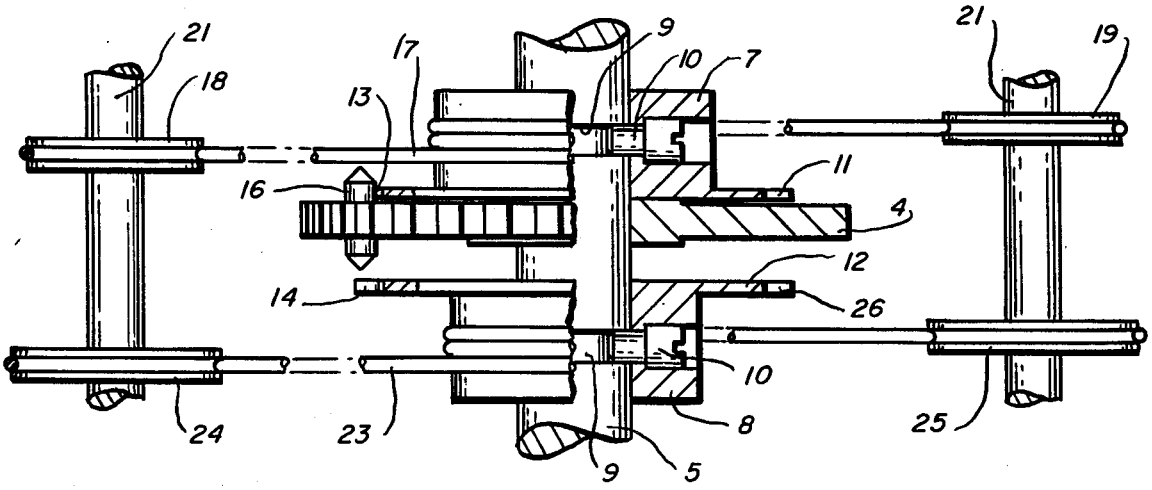
Fig_2

DUAL PITCH CARRIAGE DRIVE MECHANISM

This invention relates to escapement mechanism for controlling spacing movements of a business machine carriage; more particularly, it relates to escapement mechanism having a uniform stepping mechanism associated with two carriage drive systems which can be selectively coupled to the uniform stepping mechanism.

As noted in U.S. Pat. No. 3,540,565, dual pitch escapement members, characterized by 10 and 12 pitch escapement racks, are known to the art. Also known are escapement mechanisms as described in DE-GM (West Germany Utility Model) No. 77 00 648.

In accordance with the invention, cable drives are provided with drive wheels of different sizes which are selectively couplable to a uniform stepping mechanism.

It is an object of the invention to provide an improved dual pitch escapement mechanism to enable a printing unit carriage to letter feed in either 10 or 12 pitch steps.

Other objects and many of the attendant advantages of this invention will be readily appreciated as the same becomes better understood by reference to the following detailed description when considered in connection with the accompanying drawing in which like reference numerals designate like parts throughout the figures thereof and wherein.

FIG. 1 is a front elevational view showing dual pitch escapement mechanism in accordance with the invention; and FIG. 2 is a partial plan view of mechanism shown in FIG. 1.

Referring now to the drawing, there is shown in FIG. 1 a pinwheel 1 with 180° spaced pins 2 and 3. The pinwheel 1 is adapted to be driven one-half revolution by a motor source via a one-half revolution clutch (not shown) which is energized or engaged to couple the source and pinwheel 1 in response to a spacing signal generated by a space bar or generated incident to a character print action.

A driven disc 4 rotatably mounted on and secured against axial displacement relative to a shaft 5 is drivingly associated with the pinwheel 1 with the pinwheel axis tangent to the disc periphery. The disc 4 is provided with radial slots 6 around and open to the periphery thereof. The slots 6 are uniformly angularly spaced so that for each 180° rotation of the pinwheel 1, e.g., counterclockwise, one of the pins 2 moves into and the other pin 3 moves out of an adjacent slot 6 thereby to drive or rotatively advance the driven disc 4 by one division.

With particular reference to FIG. 2, two driven wheels, which in the embodiment shown take the form of grooved cable drums 7 and 8, are supported on the shaft 5 to either side of the driven disc 4. The cable drums 7 and 8 are rotatably supported on and secured against axial displacement relative to the shaft 5 by means of annular grooves 9 in the shaft 5 into which locating pins 10 on the cable drums 7 and 8 extend. Axial displacement of the shaft 5 acting on pins 10 carries the cable drums 7 and 8 rotatably mounted on the shaft 5 relative to the driven disc 4.

The cable drums 7 and 8 on the sides facing the driven disc 4 are formed with circular flanges or driver discs 11 and 12. Driven disc 11 on cable drum 7 has a coupling opening or notch 13 open to the periphery thereof. Driver disc 12 associated with cable drum 8 has a similar opening or notch 14 open to the periphery thereof. The notches 13 and 14 in the line beginning position of a left to right printing unit carriage 15 are aligned so that upon axial displacement of the shaft 5, one or the other of the notches 13 and 14 will receive and be coupled to a drive stud 16 mounted on and extending axially to either side of the driven disc 4 whereby an advance of the driven disc 4 will drive the cable drum 7 or 8 selectively coupled thereto.

As shown in FIG. 2, the cable drums 7 and 8 have different diameters selected to correspond to the escapement pitches desired.

A cable 17 wrapped around larger diameter cable drum 7 is trained about guide rollers 18 and 19 rotatably mounted on frame supported shafts 21 located to the left and right of the ends of a writing line, and is connected as at 22 to the printing unit carriage 15. Similarly, the smaller diameter cable drum 8 has a cable 23 wrapped therearound which is trained about similarly mounted guide rollers 24 and 25 and is connected to the printing unit carriage 15 as at 26.

FIG. 2 illustrates a basic left end position at which either cable drum 7 or 8 may be coupled to the driven disc 4 via drive stud 16. As shown in FIG. 2, the larger diameter cable drum 7 is connected to the driven disc 4 to effect carriage escapement motion of a first width as a result of each spacing signal.

To effect or select escapement of a second smaller width incident to each spacing signal, the shaft 5 is axially shifted (upwardly) from the FIG. 2 position to bring the notch 14 in the driver disc 12 of the smaller diameter cable drum 8 into coupling engagement with drive stud 16.

As will be appreciated and as depicted in FIG. 2, the cable drum 8 and associated cable 23 not coupled to the driver disc 4 will be taken along idly incident to movement of the carriage 15 by the coupled cable drum 7 and cable 17.

In a particular embodiment, to provide 10 and 12 pitch or 2.5 mm and 2.12 mm spacing increments over an 8 inch writing line, the driven disc 4 was provided with 32 slots 6; the larger cable drum 7 was 25.88 mm in diameter and the smaller cable drum 8 was 21.57 mm in diameter. Thus, over a writing line of 8 inches or 203.2 mm, the larger cable drum 7 will be rotated two and one-half revolutions to effect 80 steps of carriage movement, and the smaller drum 8 three revolutions to effect 96 steps of carriage movement.

As shown in FIGS. 1 and 2, the driver disc 12 associated with the smaller cable drum 8 is provided with a second notch 26 spaced 180° from the first notch 14 for alignment with notch 13 to enable adjustment or alignment of the carriage 15 at the end of a left to right writing line.

Due to the fact that the uniform stepping mechanism is a Geneva type mechanism, the invention not only lends itself to selecting the escapement pitch but also lends itself to switching writing directions, i.e., from left to right to right to left directions as required, for example, in writing Arabic languages, merely by reversing the rotational driving direction of pinwheel 1.

While in the embodiment disclosed, the cable drums 7 and 8 are shifted with the shaft 5 relative to the axially fixed driven disc 4; the converse, wherein the cable drums 7 and 8 are axially fixed and the driven disc 4 is moveable with the shaft 5 is within the invention. The latter is especially suitable where toothed belts instead of cables are employed to connect the dual pitch escapement mechanism to the carriage.

The invention claimed is:

1. In a business machine having a carriage mounted for character spacing movement and an escapement mechanism for controlling the character spacing movement of said carriage comprising a uniform rotary stepping mechanism, first means coupled to said carriage operative when driven by said stepping mechanism to effect a character spacing movement of said carriage through a first incremental distance, second means coupled to said carriage operative when driven by said stepping mechanism to effect character spacing movement of said carriage through a second incremental distance, and means for selectively coupling said stepping mechanism to either said first or second means according to the character spacing movement desired.

said stepping mechanism comprising a Geneva movement including a pinwheel and a coacting slotted disc, a shaft rotatably supporting said slotted disc, said pinwheel being rotatable through a predetermined angle incident to a spacing signal and operative to rotate said slotted disc, said means for selectively coupling said stepping mechanism to said first or second means comprising means on said slotted disc for engaging either said first or second means.

2. In a business machine as recited in claim 1, said first and second means being rotatably mounted on said shaft to either side of said slotted disc.

3. In a business machine as recited in claim 2, said first and second means including cable drums rotatably mounted on said shaft, and cable wound about said drums and connected to said carriage.

4. In a business machine as recited in claim 3, said cable drums being associated with driver discs having notches therein, and said means on said slotted disc comprising a pin for engaging the aligned notches on one or the other of said driver discs when the cable drums are axially moved relative to said slotted disc.

5. In a business machine as recited in claim 4, said slotted disc being axially fixed relative to said shaft and said shaft and cable drums being axially moveable as a unit relative to said slotted disc.

6. In a business machine as recited in claim 4, said notches in said driver discs being aligned at an end position of said carriage.

* * * * *